United States Patent [19]

Ganser et al.

[11] Patent Number: 4,539,513

[45] Date of Patent: Sep. 3, 1985

[54] CIRCUIT ARRANGEMENT FOR STARTING AND OPERATING A HIGH-PRESSURE GAS DISCHARGE LAMP

[75] Inventors: Hans G. Ganser, Stolberg; Ralf Schäfer, Aachen; Hans P. Stormberg, Stolberg, all of Fed. Rep. of Germany

[73] Assignee: U.S. Philips Corporation, New York, N.Y.

[21] Appl. No.: 555,225

[22] Filed: Nov. 25, 1983

[30] Foreign Application Priority Data

Dec. 11, 1982 [DE] Fed. Rep. of Germany ..... 3245923

[51] Int. Cl.[3] ..... H05B 37/00

[52] U.S. Cl. ..... 315/176; 315/173; 315/200 R; 315/241; 315/274; 315/DIG. 7

[58] Field of Search ..... 315/241 R, 176, 173, 315/200 R, 274, DIG. 7

[56] References Cited

U.S. PATENT DOCUMENTS

| | | | |
|---|---|---|---|
| 3,066,243 | 11/1962 | Mutschler | 315/241 |
| 3,376,470 | 4/1968 | Stone et al. | 315/176 |
| 3,403,293 | 9/1968 | Michelsen | 315/176 |
| 4,316,124 | 2/1982 | Verwimp et al. | 315/241 |

*Primary Examiner*—Harold Dixon

*Attorney, Agent, or Firm*—Robert T. Mayer; Bernard Franzblau

[57] ABSTRACT

A circuit arrangement for starting and operating a high-pressure gas discharge lamp having an outer starting electrode connected to an igniter. A full-wave rectifier (1) is connected to an alternating voltage supply (A, B) and has an output shunted by a series arrangement of a diode (4) and a capacitor (5). The capacitor is discharged in part through the lamp (3) after each half period of the alternating voltage. A resistor (6), which is high-ohmic with respect to a current limiter (2), is connected in the current circuit between the end of the capacitor (5) facing the diode (4) and the lamp (3). Thus, starting of the lamp is facilitated.

9 Claims, 3 Drawing Figures

Figure 1:
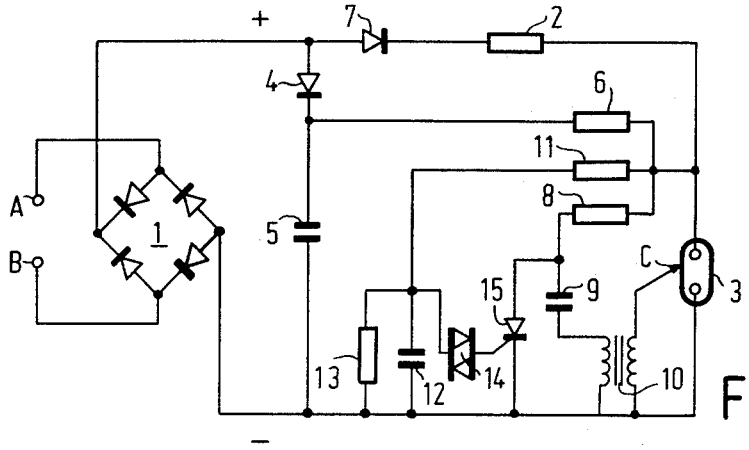

CIRCUIT ARRANGEMENT FOR STARTING AND OPERATING A HIGH-PRESSURE GAS DISCHARGE LAMP

The invention relates to a circuit arrangement for starting and operating a high-pressure gas discharge lamp having an outer starting electrode, the discharge lamp being connected in series with a current limiter to a voltage source and a starting-pulse producer being provided, which comprises a pulse transformer connected on the secondary side to the starting electrode and on the primary side to a pulse capacitor as well as a controlled switching element.

A problem in starting and operating high-pressure gas discharge lamps is the primary ignition of the lamps, that is to say the starting of the cold lamps, and the re-ignition after each zero passage of the mains alternating current, after each d.c. pulse, respectively. This holds essentially for all high-pressure gas discharge lamps, for example, for mercury vapour- or sodium vapour discharge lamps, especially, however, for metal halide discharge lamps.

In order to facilitate starting of high-pressure gas discharge lamps, it is known, for example, from U. S. Pat. No. 4,223,247 and from DE-OS No. 3109539 to provide the discharge lamps with an outer starting electrode and to apply between this electrode and one of the main electrodes a high-frequency high-voltage pulse for starting. The starting electrode takes, for example, the form of a wire loop or helical wire wound around a discharge tube of the lamp. It may also be a needle of wire provided near that discharge tube. However, the lamp is then not always started regularly with the first starting pulse. Frequently, the lamp ignites during the first starting pulse only for a short time and then extinguishes again. Only after the starting pulse has been repeated several times, the lamp begins to operate continuously. This starting behaviour adversely affects the life of the lamp due to the fact that a frequent ignition causes the discharge tube to be strongly blackened.

However, the lamp can be prevented from igniting several times upon starting if a comparatively high voltage of 300 to 400 V is applied between the main electrodes of the lamp, but such high voltages are not supplied without further expedients by a conventional alternating voltage mains.

The invention has therefore for its object to provide a circuit arrangement for starting and operating a high-pressure gas discharge lamp in which the lamp begins to operate continuously already upon the occurrence of the first starting pulse although the voltage applied to the main electrodes of the lamp is comparatively low and lies at least below the mains alternating voltage.

According to the invention, this is achieved in a circuit arrangement of the kind mentioned in the opening paragraph in that the voltage source is a full-wave rectifier which is connected to an alternating voltage mains and whose output is shunted by a series arrangement of a diode and a further capacitor, which is discharged at least in part through the lamp after each half period of the mains alternating voltage, a resistor, which is high-ohmic with respect to the current limiter, being included in the current circuit between the end of this capacitor facing the diode and the lamp.

In high-pressure gas discharge lamps, at the heating-up stage, which, depending upon the lamp size, has a duration between about 30 seconds and 5 minutes after the primary ignition, comparatively high re-ignition voltages are required, which cannot be supplied without further expedients by the voltage source so that the lamps then extinguish. When a series arrangement of a diode and a further capacitor is used, this capacitor is charged through the diode to the peak value of the mains voltage before the lamp is started. After the primary ignition of the lamp, that is to say after a current can flow through the lamp due to the ionization of the lamp by the starting pulse, the further capacitor is discharged at least in part through the lamp. As a result, especially at the heating-up stage re-ignition difficulties are avoided, that is to say that the lamp does not extinguish even after the zero passages of the mains alternating voltage succeeding the primary ignition. It is sufficient if the capacitor, depending upon the lamp type, has a value lying between 10 nF and 1 $\mu$F. In order to avoid re-ignition difficulties, it is sufficient if in the discharge current circuit there flows between the capacitor and the lamp a very small current as compared with the average lamp current, whereby said small current, depending upon the lamp size, lies between 1 and 30 mA. This is attained by the high-ohmic resistor. At the same time, a considerable discharge of the comparatively small further capacitor is then avoided.

It is a surprise to find that with this circuit arrangement also the starting properties of high-pressure gas discharge lamps having an outer starting electrode can be improved, whereby presumably the so-called glow arc transition in the lamps is facilitated. In high-pressure gas discharge lamps, first a low-current flow discharge is activated by the starting pulse. The transition from this glow discharge to a high-current arc discharge, on the contrary, takes place especially in high-pressure gas discharge lamps having a very small content of the discharge tube only at a sufficiently high voltage across the main electrode of the lamp. In the circuit arrangement according to the invention, this flow-arc-transition is presumably facilitated in that about the peak value of the mains voltage is permanently available at the further capacitor even if the mains voltage decreases in the proximity of the zero passages and hence the glow-arc-transition becomes difficult.

Thus, the starting process is considerably improved due to the circuit part constituted by the diode, the further capacitor and the high-ohmic resistor. Without this circuit part, the starting pulse has to be repeated several times until the lamp operates continuously, whilst, when the relevant circuit part is switched into circuit, the primary ignition occurs regularly upon the occurrence of the first starting pulse.

According to an advantageous further embodiment of the circuit arrangement in accordance with the invention, the further capacitor serves at the same time as the pulse capacitor, which results in that the circuit arrangement is simplified and a saving of elements is obtained.

In the simplest case, the current limiter is an ohmic resistor which is connected in series with a further diode. However, the current limiter may alternatively be an electronic ballast unit, for example, a chopper or a blocking or forward converter, in front of which a further diode is connected in series, the end of the high-ohmic resistor facing the lamp being connected between this further diode and the ballast unit.

A switching transistor, which in such ballast units is usually connected in series with the lamp, is conducting in the proximity of the zero passages of the mains alternating voltage as well as in the case of a nonignited lamp or upon the occurrence of a low-current glow discharge so that then a current can flow from the capacitor via the high-ohmic resistor through the lamp.

Figure 2:
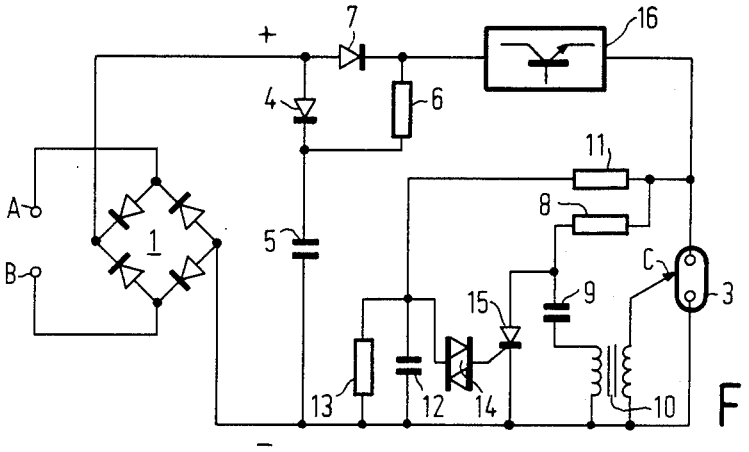
Figure 3:
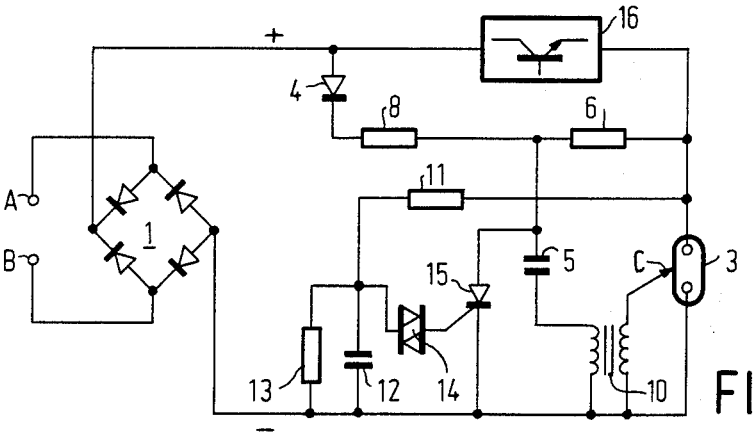

Some embodiments of the invention will now be described more fully with reference to the accompanying drawing, in which:

FIG. 1 shows a circuit arrangement for starting and operating a high-pressure gas discharge lamp having an ohmic resistor as current limiter, FIG. 2 shows a circuit arrangement for starting and operating a high-pressure gas discharge lamp having an electronic ballast unit as current limiter, and FIG. 3 shows a modified circuit arrangement of this kind in which a capacitor connected in series with a diode serves at the same time as a pulse capacitor of an igniter of the lamp.

A and B designate input terminals for connection to an alternating voltage mains of 220 V, 50 Hz. As the case may be via a mains filter, there is connected to these input terminals a full-wave rectifier 1 comprising four diodes, which produces a pulsatory direct current. A high-pressure gas discharge lamp 3 is connected in series with a current limiter 2 to the output of the full-wave rectifier 1. The output of the full-wave rectifier 1 is moreover shunted by a series arrangement of a diode 4 and a capacitor 5. A resistor 6, which is high-ohmic with respect to the current limiter 2, is connected between the end of the capacitor 5 facing the diode and the lamp 3. The current limiter 2 is in this case an ohmic resistor 2 which is connected in series with a further diode 7 in order to prevent return currents from flowing.

Through a resistor 8 a pulse capacitor 9, which is connected in series with the primary of a pulse transformer 10 for the ignition of the lamp is charged to the voltage $U_L$ applied across the discharge lamp 3 (i.e. the rectified mains voltage in the non-ignited condition), while at the same time a capacitor 12, which has connected parallel to it a resistor 13, is charged via a resistor 11 to the voltage $R_{13}U_L/(R_{11}\times R_{13})$. As soon as the voltage at the capacitor 12 attains the ignition voltage $U_Z$ of a trigger diode 14 (about 30 V), this trigger diode 14 and subsequently also a thyristor 15 connected thereto become conducting so that the pulse capacitor 9 is discharged through the primary of the transformer 10 and then produces in its secondary a voltage pulse of a few kV, which is applied to a starting electrode C of the lamp 3. After the discharge of the pulse capacitor 9, the thyristor 15 again becomes high-ohmic. When the lamp 3 is started, the voltage $U_L$ applied to the lamp falls to the operating voltage of the lamp. By a suitable choice of the resistance ratio $R_{13}/(R_{11}+R_{13})$ it can be achieved that in this condition the ignition voltage $U_Z$ of the trigger diode 14 is no longer attained so that, when the lamp operates, starting pulses are no longer produced.

Before the lamp 3 is started, the capacitor 5 is charged through the diode 4 to the peak value of the mains voltage of about 300 V, the diode 4 serving to prevent the capacitor 5 from being discharged during the zero passages of the mains alternating voltage. After the lamp has started, that is to say during the periods of the mains alternating voltage succeeding the primary ionization by the starting pulse, the capacitor 5 is discharged at least in part through the lamp 3. The high-ohmic resistor 6 then serves to limit the capacitor discharge current to small values between about 1 and 30 mA, so that the voltage at the capacitor 5 decreases only slightly and the lamp 3 thus has available during the overall heating-up stage a substantially constant voltage. Surprisingly, the starting property of the lamp 3 is improved simultaneously, that is to say that the primary ignition of the lamp occurs regularly already at the first starting pulse.

With this circuit arrangement, for example, 45 W metal halide lamps not only can be ignited perfectly, but these lamps also pass through their heating-up stage without re-ignition problems. Moreover, it has been found that in these lamps the primary ignition was still possible at mains alternating voltages down to 150 V, whereas without the further capacitor 5 with the diode 4 and the resistor 6 being switched into circuit the lamps could be started only at input voltages exceeding the usual mains alternating voltage.

In a practical embodiment comprising a 45 W metal halide discharge lamp, the elements used had the following values:

Resistor 2: 250Ω
resistor 6: 300 kΩ
resistor 8: 200 kΩ
resistor 11: 1 MΩ
resistor 13: 300 kΩ
capacitor 5: 200 nF,
capacitor 9: 100 nF,
capacitor 12: 30 nF,
Transmission ratio of the transformer 10=1:30.

In the circuit arrangement of FIG. 2, the current limiter is an electronic ballast unit 16, as described, for example, in U.S. Pat. No. 3,890,537. Again a further diode 7 is connected in front of this ballast unit 16. The end of the high-ohmic resistor 6 facing the lamp is connected between this further diode 7 and the ballast unit 16. Also in this case the high-ohmic resistor 6 contributes to the reduction of the discharge current from the capacitor 5 via the ballast unit 16 through the lamp 3 during the zero passages of the mains alternating voltage. The further diode 7 prevents a return current from flowing from the capacitor 5 to the full-wave rectifier 1. At the same time, it is achieved by the circuit part constituted by the diode 4, the further capacitor 5 and the high-ohmic resistor 6 that the lamp 3 ignites at the first starting pulse.

If the electronic ballast unit 16 is, for example, a forward converter, the switching transistor of this converter is switched to the conductive state in the proximity of the zero passages of the mains alternating voltage as well as in the case of a non-ignited lamp or upon the occurrence of a glow discharge of only low current so that for this time a current can flow from the capacitor 5 via the high-ohmic resistor 6 directly to the lamp 3. Outside the zero passages of the mains alternating voltage, the switching transistor of the electronic ballast unit 16 usually operates only with a duty cycle of about 30% so that the current from the capacitor 5 via the high-ohmic resistor 6 is likewise interrupted with this duty cycle. The dissipation in the high-ohmic resistor 6 is correspondingly reduced to 30%, which, however, does not adversely affect the ignition behaviour of the lamp 3 because the additional current from the capacitor 5 has to flow through the lamp 3 only in the proximity of the zero passages of the mains alternating voltage as well as upon the occurrence of a glow discharge.

In a practical embodiment comprising a 45 W metal halide discharge lamp, the elements used had the same values as in the embodiment of FIG. 1.

A simplification of a circuit arrangement equipped with an electronic ballast unit 16 is shown in FIG. 3. In this case, the further capacitor 5 is used at the same time as a pulse capacitor for producing the starting pulse of the lamp 3. The capacitor 5 is now connected in series with the diode 4, the limiter resistor 8 and the primary of the transformer 10. In comparison with the two preceding embodiments, the resistor 8 now has, the elements being otherwise the same, a value of only 20 kΩ.

In the circuit arrangements of FIGS. 1 and 3, the high-ohmic resistor 6 may also be connected to the lamp 3 through an additional switching transistor, which leads to a reduction of the dissipation in the high-ohmic resistor 6.

What is claimed is:

1. A circuit arrangement for starting and operating a high-pressure gas discharge lamp having an outer starting electrode comprising, means connecting the discharge lamp in series with a current limiter to a voltage source, a starting-pulse producer which comprises a pulse transformer connected on the secondary side to the starting electrode and on the primary side to a pulse capacitor and to a controlled switching element, characterized in that the voltage source is a full-wave rectifier connected to an alternating voltage supply and having an output shunted by a series arrangement of a diode and a further capacitor which is discharged at least in part through the lamp after each half period of the alternating voltage, a resistor, which is high-ohmic with respect to the current limiter, connected in the current circuit between the end of said capacitor facing the diode and the lamp.

2. A circuit arrangement as claimed in claim 1, wherein the further capacitor has a value between 10 nF and 1 μF.

3. A circuit arrangement as claimed in claim 1 wherein the further capacitor serves at the same time as the pulse capacitor.

4. A circuit arrangement as claimed in claim 1 wherein the current limiter is an ohmic resistor connected in series with a further diode.

5. A circuit arrangement as claimed in claim 1 wherein the current limiter is an electronic ballast unit, in front of which a further diode is connected in series, the end of the high-ohmic resistor facing the lamp being connected between said further diode and the ballast unit.

6. A circuit arrangement as claimed in claim 2, wherein the further capacitor serves at the same time as the pulse capacitor.

7. A circuit arrangement as claimed in claim 2, wherein the current limiter comprises an ohmic resistor connected in series with a further diode.

8. A circuit arrangement as claimed in claim 3, wherein the current limiter comprises an ohmmic resistor connected in series with a further diode.

9. A circuit arrangement as claimed in claim 6, wherein the current limiter comprises an ohmmic resistor connected in series with a further diode.

* * * * *